US011754070B2

(12) United States Patent
Soderstrom

(10) Patent No.: US 11,754,070 B2
(45) Date of Patent: Sep. 12, 2023

(54) PUMP DEVICE, ESPECIALLY FOR MOBILE MEANS OF TRANSPORT

(71) Applicant: Bricks Groupe LLC, Boca Raton, FL (US)

(72) Inventor: Harry Soderstrom, Marietta, GA (US)

(73) Assignee: Bricks Group, LLC, Kennesaw, GA (US)

( * ) Notice: Subject to any disclaimer, the term of this patent is extended or adjusted under 35 U.S.C. 154(b) by 134 days.

(21) Appl. No.: 16/740,734

(22) Filed: Jan. 13, 2020

(65) Prior Publication Data

US 2020/0224664 A1 Jul. 16, 2020

(30) Foreign Application Priority Data

Jan. 11, 2019 (DE) ..... DE10 2019 100 589

(51) Int. Cl.

| | |
|---|---|
| ***F04C 2/12*** | (2006.01) |
| ***F04C 2/08*** | (2006.01) |
| ***F04C 15/00*** | (2006.01) |
| ***F04D 29/04*** | (2006.01) |
| ***F04D 29/044*** | (2006.01) |

(52) U.S. Cl.

CPC ..... *F04C 2/126* (2013.01); *F04C 2/08* (2013.01); *F04C 2/12* (2013.01); *F04C 15/0073* (2013.01); *F04D 29/0405* (2013.01); *F04C 2240/30* (2013.01); *F04C 2240/60* (2013.01); *F04D 29/044* (2013.01)

(58) Field of Classification Search

CPC .... F04C 2/08; F04C 2/12; F04C 2/126; F04C 2240/30; F04C 2240/60; F04C 15/0073; F04D 29/0405; F04D 29/044

See application file for complete search history.

(56) References Cited

U.S. PATENT DOCUMENTS 2,451,603 A * 10/1948 Barker ..... F04C 2/126 418/150
2,564,838 A * 8/1951 Garey ..... F04D 29/044 403/81
2,654,325 A * 10/1953 Minshall ..... F04C 2/14 418/81
2,672,823 A * 3/1954 Thomson ..... F04C 2/126 418/206.7
2,708,548 A * 5/1955 Blanton ..... F04C 2/126 418/179

(Continued)

FOREIGN PATENT DOCUMENTS

DE 10 2018105723 A1 9/2018
EP 2 306 023 B1 6/2016

OTHER PUBLICATIONS

Machine Translation of DE 102018105723.*

*Primary Examiner* — Christopher S Bobish

(74) *Attorney, Agent, or Firm* — Miller & Martin PLLC; Stephen J. Stark

(57) ABSTRACT

A pump apparatus (1) for use in mobile means of transport (100) such as semitrailers, tank trailers, tank semitrailers (101), tank trucks and trucks (102), has a drive motor (40) and a rotary piston pump (2) having two rotor units (10, 20) on rotatably mounted rotor shafts (11, 21), connected to rotor gear wheels (12, 22). A drive pinion (32) of a drive shaft (31) coupled to one of the rotor gear wheels (12) and is received in a recess (81) of the motor shaft (41).

17 Claims, 5 Drawing Sheets

(56) References Cited

U.S. PATENT DOCUMENTS

Figure 1:
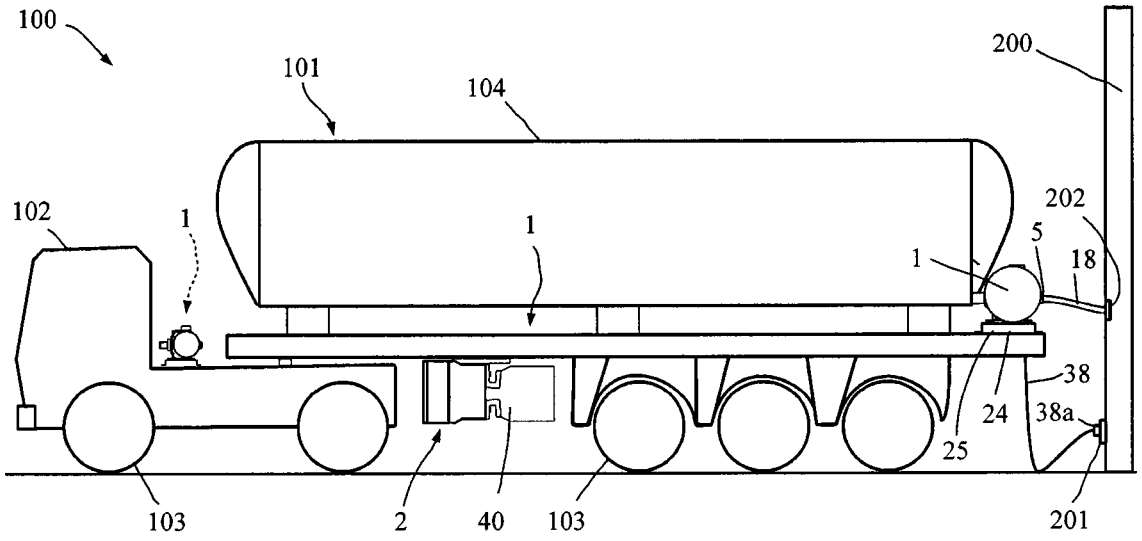

| | | | | | |
|---|---|---|---|---|---|
| 2,880,676 | A * | 4/1959 | Succop | F04C 2/086 | 417/410.4 |
| 3,198,120 | A * | 8/1965 | Little, Jr. | F04C 14/02 | 417/252 |
| 3,674,378 | A * | 7/1972 | Erickson | F04D 29/586 | 416/177 |
| 5,992,230 | A * | 11/1999 | Scarpa | F04C 2/126 | 418/206.5 |
| 6,244,842 | B1 * | 6/2001 | Tieben | F01C 21/02 | 403/359.1 |
| 6,398,521 | B1 * | 6/2002 | Yorulmazoglu | F04D 13/021 | 403/298 |
| 6,709,234 | B2 * | 3/2004 | Gilbert | F04D 7/065 | 415/200 |
| 8,162,625 | B1 * | 4/2012 | Soderstrom | F04C 11/00 | 417/360 |
| 8,821,141 | B2 * | 9/2014 | Helgeson | F04C 15/0073 | 418/104 |
| 2008/0193316 | A1 * | 8/2008 | Fujii | F04C 11/005 | 418/201.3 |
| 2012/0244021 | A1 * | 9/2012 | Umeyama | F16B 39/284 | 417/360 |
| 2013/0302137 | A1 * | 11/2013 | Meessmann | F04D 29/043 | 415/1 |
| 2015/0361978 | A1 * | 12/2015 | Cho | F04C 11/001 | 418/83 |
| 2018/0045209 | A1 * | 2/2018 | Nowitzki | F04D 1/06 | |
| 2018/0209418 | A1 * | 7/2018 | Chu | F04C 11/005 | |

* cited by examiner

PUMP DEVICE, ESPECIALLY FOR MOBILE MEANS OF TRANSPORT

The present invention relates to a mobile pump apparatus in particular for use with mobile means of transport such as semitrailers, tank trailers, tank semitrailers, tank trucks and trucks. The mobile pump apparatus comprises a rotary piston pump with a housing and two pump openings configured thereat, one of which serves as a pump inlet and the other, as a pump outlet. Furthermore the housing rotatably receives at least two rotor units in a pump chamber for conveying a fluid from the pump inlet to the pump outlet. The mobile pump apparatus according to the invention preferably conveys liquids in the field of foodstuffs which may in particular show high degrees of viscosity. For example honey having a viscosity of about 10,000 may be packaged. Packaging grape juice or olive oil showing a viscosity of about 100 is also possible. Food additives or other liquids may be packaged as well. Heating during packaging may optionally be provided for adjusting the viscosity of the packaged fluid in the desired range.

A number of pump apparatuses have been disclosed in the prior art for packaging foodstuffs or chemicals. For example U.S. Pat. No. 2,880,676 discloses a combination of a motor and a pump, which pump is a gear-type rotary pump or lobular pump, comprising two pistons rotating in opposite directions. The rotating pistons of the lobular pump are driven via intermeshing gear wheels connected with a drive pinion. The motor is disposed vertically above the pump so that the area beneath the motor can be maintained hygienically clean. The known pump apparatus is basically functional and easily kept clean. However, this pump-motor-combination is not suitable for mobile use since this known combination has a large footprint. Use with tank trailers or trucks in particular tends to involve very limited available space.

DE 20 2017 101 444 U1 discloses a mobile pump apparatus in which a motor shaft of an electric motor drives a drive shaft of a rotary piston pump. A standard electric motor is employed which, in case of a defect, is available nearly everywhere. Thus, exchange in the case of a defect is possible within a very short time on the same day or within one or two days since these electric motors are available in any region with road cargo traffic. This is significant for maintaining trouble-free operation and for ensuring timely deliveries.

EP 2 306 023 B1 has disclosed a pump apparatus including a motor, a reduction gear transmission and a rotary piston pump with selectable mounting options, which is also employed in mobile applications. The known rotary piston pump apparatus shows an electric drive motor connected with a separate reduction gear transmission. On its output side the reduction gear transmission rotates at a rotational speed that is lower than the motor's rotational speed. The output shaft of the reduction gear transmission activates a drive shaft of the rotary piston pump which transmits the rotation to an intermediate shaft disposed in parallel via interlinked gear wheels. The drive shaft and the intermediate shaft of the rotary piston pump are each equipped with a rotary piston and guide the fluid to be conveyed from the pump inlet to the pump outlet. In the rotary piston pump the driving force is distributed between the drive shaft and the intermediate shaft. The rotary piston pump may be attached to a fastening flange of the reduction gear transmission in 4 positions offset 90° each so that the pump inlet and the pump outlet may be oriented in different directions. The drawback of this known rotary piston pump apparatus is the elongated structure and the high total weight since the apparatus comprises, other than the drive motor, also the reduction gear transmission and the rotary piston pump with the reduction gearing for distributing the drive speed between the drive shaft and the intermediate shaft, and the rotary piston proper.

It is therefore the object of the present invention to provide a mobile pump apparatus in particular for use with mobile means of transport such as semitrailers, tank trailers, tank semitrailers, tank trucks and trucks, and a mobile means of transport comprising a mobile pump apparatus, wherein the mobile pump apparatus allows reliability of operation and ease of exchanging defective parts, is compact, and has the lowest total weight possible.

This object is solved by a mobile pump apparatus having the features of claim 1 and by a mobile means of transport. Preferred specific embodiments of the invention are the subjects of the subclaims. Further advantages and features of the present invention can be taken from the general description and the description of the exemplary embodiments.

A mobile pump apparatus according to the invention is in particular suitable and provided for use with mobile means of transport such as semitrailers, tank trailers, tank semitrailers, tank trucks and trucks and the like. The mobile pump apparatus comprises a drive motor and a rotary piston pump, the drive motor including a motor shaft for driving the rotary piston pump.

The rotary piston pump comprises a housing and two pump openings configured thereat, one of which serves as a pump inlet and the other, as a pump outlet. At least two rotor units are provided rotatably accommodated in a pump chamber in the housing for conveying a fluid and in particular a liquid from the pump inlet to the pump outlet. The two rotor units are rotatably supported on rotor shafts (preferably outside of the pump chamber) where they are accommodated (in particular exchangeably). Each of the rotor shafts is equipped with a rotor gear wheel disposed outside of the pump chamber. A drive pinion of a drive shaft of the rotary piston pump is coupled with one (and in particular exactly one) of the rotor gear wheels. The motor shaft of the drive motor has at its front end a recess where the drive shaft of the rotary piston pump is accommodated and (non-rotatably) coupled with the drive shaft. Coupling may for example be carried out through a coupling device.

The mobile pump apparatus according to the invention has many advantages. A considerable advantage of the mobile pump apparatus according to the invention consists in a recess made in the motor shaft of the drive motor, allowing compact coupling with the drive shaft of the rotary piston pump. Basically, a standard electric motor, which is available at short notice, can be used. If a defect occurs, the motor shaft may be exchanged or specifically reworked. Supplying a suitable motor shaft and exchange on site is possible at short notice. Local reworking of the motor shaft on site is also possible so as to allow prompt exchanges in the case of defects. Thus, delivery dates promised can as a rule be kept even if defects occur in the electric motor.

Another advantage is that the pump apparatus can be still more compact in structure. The motor shaft encompassing the drive shaft allows to achieve a particularly small, compact configuration. Moreover, weight may be saved. The mounting length of the mobile pump apparatus can in particular be reduced.

Preferably both of the rotor gear wheels show identical numbers of teeth and are coupled with one another for rotation in opposite senses. The toothing of the drive pinion in particular engages the toothing of one of the rotor gear wheels.

The drive pinion with the rotor gear wheel in particular constitutes a reduction gear transmission so that the rotor units rotate slower than does the drive pinion. The drive shaft is configured to be coupled with a drive motor in a speed ratio of 1:1. The rotation axes of the rotor gear wheels in particular open up a rotor plane and a rotation axis of the drive pinion is disposed at a lateral distance from the rotor plane.

Preferably the motor shaft of the drive motor is coupled with the drive shaft through at least one coupling device including at least one coupling unit.

The need for a separate, intermediate reduction gear transmission to which the drive motor is flange-mounted, is eliminated. The reduction gear transmission is incorporated in the rotary piston pump. For distributing the driving power and for concurrent rotation of both of the rotor units the drive speed is transmitted to a rotor gear wheel of a rotor shaft via a drive pinion. Due to the coupling of the two rotor gear wheels in opposite senses the rotation of one rotor shaft is transmitted to the other rotor shaft so that both rotor units operate in opposite senses at the same rotational speeds while conveying the fluid from the pump inlet to the pump outlet. A separate reduction gear transmission stage can be omitted so as to save considerable weight. In a concrete example the total weight has been lowered further by a considerable amount allowing a reduction of more than 10% or 12% or even 15% or 17% and in one example, specifically clearly above 20 kilos, over the previous prior art. Given a total weight reduced to about 125 kilos this is a considerable reduction which in the case of mobile means of transport contributes to noticeably reduced energy consumption.

In a configuration with the drive shaft disposed laterally spaced apart from the rotor plane opened up by the rotation axes of the rotor gear wheels, the structural height can be considerably reduced in the direction of the rotor plane. The rotation axes of the rotor gear wheels and the drive pinion form a triangle relative to one another which considerably saves mounting space. The mobile pump apparatus according to the invention is not only more lightweight but also more compact. Furthermore, the mounting length may be reduced still further. This provides a wider range of application in means of transport which tend to show cramped space.

In all the configurations the rotation axes of the drive pinion and of the rotor gear wheels are preferably disposed in parallel to one another. A reduction transmission from the drive pinion to the rotor gear wheel respectively a ratio of the numbers of teeth of the drive pinion versus the rotor gear wheel is preferably less than 1:2 and in particular less than 1:2.5 and may be less than 1:3 or 1:4 or 1:8. Particularly preferably it may be 1:5 or 1:6 or 1:7.

In a preferred specific embodiment a (vertical or perpendicular) projection of the rotation axis of the drive pinion onto the rotor plane opened up by the rotation axes of the rotor gear wheels is located between the rotation axes of the rotor gear wheels. This achieves a particularly compact structure. Such a triangle opened up by the three rotation axes does not show internal angles of larger than 90° so as to achieve a particularly compact structure. Both the height of the pump apparatus and the width of the pump apparatus may be selected to be small.

Preferably the drive pinion does not protrude beyond an upper edge of the highest of the two rotor units. This allows to achieve a particularly low total height of the mobile pump apparatus according to the invention.

Preferably the motor shaft comprises at its front end a coupling section where the recess is configured in the interior of the motor shaft. The recess is configured in particular over the entire length of the coupling section which it may define.

The drive motor preferably comprises a motor housing. The coupling section may be disposed entirely outside of the motor housing or it may be disposed at least partially inside of the motor housing.

The motor shaft comprises in particular a coupling section outside of the motor housing and may comprise a second section in particular inside of the motor housing (inner section).

Preferably the coupling section of the motor shaft is defined by a cylindrical peripheral surface abutting the motor shaft at least in sections or nearly entirely or entirely. The outer surface of the motor shaft may be completely cylindrical but it may be configured non-round.

The recess in particular forms a substantially cylindrical cavity. The inner periphery may be configured (in terms of geometry, substantially) as a cylindrical cavity.

Preferably the recess comprises at least one longitudinal groove. Alternately, two, three or more longitudinal grooves may be formed. Then the inner cross section departs from a cylinder shape in these locations.

The recess may generally show a non-round inner contour. The recess may be configured e.g. with an internal toothing. Then the drive shaft is in particular configured with an external toothing interacting with the internal toothing of the recess. The numbers of teeth may be identical or different, in any case they are matched to one another.

Preferably at least one coupling unit is comprised which interacts with at least one coupling unit on the drive shaft and/or the motor shaft. Different, separate coupling units or separate coupling parts or coupling contours may be provided and/or comprised.

At least one transverse opening extending (in particular at least substantially in the transverse direction or in the transverse direction) is in particular configured in the drive shaft and/or the motor shaft where a non-rotatable coupling of the drive shaft and the motor shaft is achieved via at least one coupling unit disposed therein. For example a transverse hole may be configured in which a screw or a securing pin or coupling pin is inserted to achieve a coupling secure against rotation.

Particularly preferably a coupling unit or a spring is provided which may be inserted in the two axial grooves of the drive shaft and the motor shaft to achieve a non-rotatable coupling of the motor shaft and the drive shaft.

Preferably the drive pinion is in direct meshing engagement with one of the rotor gear wheels. It is also conceivable for the drive pinion to be coupled with the rotor gear wheel via a chain or a belt.

In particularly preferred specific embodiments the drive motor is configured as an electric motor and is in particular driven by rotary current. Preferably the electric motor shows a power range between 1 kW and 15 kW. The electric motor in particular shows power in the power range between 5 kW and 10 kW. The drive motor can in particular be operated by way of a rotary current connection or power current connection of an ordinary house or building or an industrial plant. Power stages of for example less than 7 KW or less than 8 KW are possible. Alternately it is conceivable to use a hydraulic motor drive which may in particular be operated for example by means of the hydraulic circuit of a mobile means of transport. This configuration shows the advantage that no electric connection or at least no high-power connection is required.

In advantageous configurations the housing comprises a pump housing part and a gear housing part. Then the rotor gear wheels and the drive pinion are preferably accommodated in the gear housing part. The pump chamber with the rotor units is preferably accommodated in the pump housing part.

Particularly preferably the gear housing part and the pump housing part each comprise a/n (end) wall respectively partition wall. At least in the region of the shaft bushings a free distance with an outwardly connection is preferably provided between the gear housing part and the pump housing part. This reliably prevents oil from flowing out of the gear housing part into the pump housing part and also filled product, from flowing into the pump housing part. In case that a shaft bushing of a rotor shaft develops a leak, the oil or product first escapes to the exterior and will be detected fast. Disk parts may be disposed between the two housing parts to ensure a defined distance. The disk parts may show the form of washers and may for example be guided by, or pushed onto, the mounting screws.

Preferably, bearing units are disposed in the gear housing part for supporting the drive shaft and the rotor shafts. Preferably, pairs of bearing units for at least one of the shafts mentioned are disposed in the gear housing part. Bearing units for supporting the rotor shafts are in particular disposed only and exclusively in the gear housing part.

Preferably the pair of bearing units of a rotor shaft is axially disposed between the rotor unit (mounted onto, or configured on, the rotor shaft) and the rotor gear wheel (mounted onto, or configured on, the rotor shaft). This enables a compact construction and reliable support.

In particular the housing and preferably the pump housing part comprises a lid closing the pump chamber wherein the rotor units are in particular accessible from the outside after demounting the lid.

The rotary piston pump preferably comprises two rotor units, each comprising a plurality of two and preferably three rotor elements. This means that the rotary piston pump comprises a lobular pump and preferably a rotary piston pump.

In all the configurations it is preferred for the rotor units to be pushed onto the rotor shafts where they are attached, and preferably screwed, in particular to the fronts of the rotor shafts.

Advantageously the drive motor is flange-mounted to the housing and in particular to the gear housing part or to a clutch housing part connected with, or comprised in, the housing.

Preferably the drive motor is connected with the housing via a connecting flange. The connecting flange is preferably U-shaped in cross section. The cross section (in the longitudinal direction) may also show the form of a U, V, W or H. All of these cross sections are presently encompassed in the term substantially U-shaped. What is substantial is, two circumferential and spaced apart flanges connected to one another in a central or centric region, for example tubular. The axial distance of the flange parts is preferably smaller than the clear internal diameter of the tubular section. One of the flanges preferably forms the end of the gear housing and the other of the flanges is preferably connected with the front end of the motor housing or forms the front end flange of the motor housing. It is also possible and preferred for the connecting flange to be substantially disk-shaped or annular. The connecting flange may in particular be configured as a flat ring or disk. This allows a particularly short design.

In particularly preferred configurations the connecting flange forms an end of the housing and the motor housing. This allows a particularly compact, lightweight while stable design.

Preferably an electric control unit is comprised which allows controlling the conveyance. Preferably the control unit comprises a frequency converter. The control unit in particular allows controlling and changing the conveying direction by way of operating the rotary piston pump in the reverse rotational direction. In advantageous configurations the pump apparatus comprises an electric connecting cable for power supply, wherein said power supply is in particular provided by a (an ordinary) power connection of a house or industrial plant.

In all the configurations it is preferred for the diameter of the drive motor to be smaller than the height of the pump housing. Preferably the drive motor is connected with, and/or flange-mounted to, the housing in a central height region.

In preferred configurations the length of the housing of the rotary piston pump is shorter than the length of the drive motor. Preferably the length of the pump apparatus is shorter than twice, or in particular shorter than 1.5 times, the length of the housing. Thus, a compact pump apparatus is provided.

In preferred configurations the rotation axis of the drive pinion is vertically offset relative to a middle plane between the rotation axes of the rotor gear wheels. A slight vertical offset ensures that the drive pinion drives only one of the rotor gear wheels. This is to ensure that the rotor units rotate in opposite senses. The vertical offset is preferably less than ½ and in particular less than ⅓ and preferably less than ¼ and particularly preferably less than ⅕ or even ⅙ of the distance of the rotation axes of the rotor gear wheels. This achieves a particularly compact structure.

The pump apparatus preferably includes at least one and in particular two foot units disposed symmetrically on the housing of the pump apparatus which in particular include leg units or legs extending obliquely rearwardly and downwardly in the direction of the drive motor and supported on elongated feet. The feet are larger in length than are the legs. This achieves a stable structure. The construction is low-vibration and vibration damping.

The mobile means of transport according to the invention such as a semitrailer, tank trailer, tank semitrailer, tank truck or truck comprises a storage tank and connected thereto, a pump apparatus with a rotary piston pump and a drive motor. The rotary piston pump comprises a housing and two pump openings configured thereat, one of which serves as a pump inlet and the other, as a pump outlet. At least two rotor units rotatably accommodated in a pump chamber in the housing are provided for conveying a fluid from the pump inlet to the pump outlet. The pump apparatus is configured as described above.

The two rotor units are in particular accommodated on rotatably supported rotor shafts, each of the rotor shafts being equipped with a rotor gear wheel accommodated outside of the pump chamber. The two rotor gear wheels preferably show identical numbers of teeth and are coupled to one another in particular for rotation in opposite senses. A drive pinion of a drive shaft is coupled with one of the rotor gear wheels. The drive pinion together with the rotor gear wheel forms a reduction gear transmission so that the rotor units rotate slower than does the drive pinion. The drive shaft is coupled with a drive motor at a speed ratio of 1:1.

The means of transport according to the invention also shows many advantages. The means of transport may have a lower total weight and provide more room for loads and transport since the rotary piston pump provided in the mobile means of transport is compact and has a low total weight.

Preferably the drive motor of the rotary piston pump is configured as an electric motor and can be connected through a connecting cable with a stationary power connection for example in a house or an industrial plant. Alternately it is possible to provide a hydraulic motor as a drive motor and for the hydraulic motor to be connected with and controlled by a hydraulic circuit of the mobile means of transport.

In all the configurations preferably at least the pump housing part, the rotor shafts and the pertaining rotor elements (and in particular the rotor units overall) consist of steel and in particular special-purpose steel and particularly preferably of stainless steel.

Further advantages and features of the present invention can be taken from the description of the exemplary embodiments which will be discussed below with reference to the enclosed figures.

Figure 2:
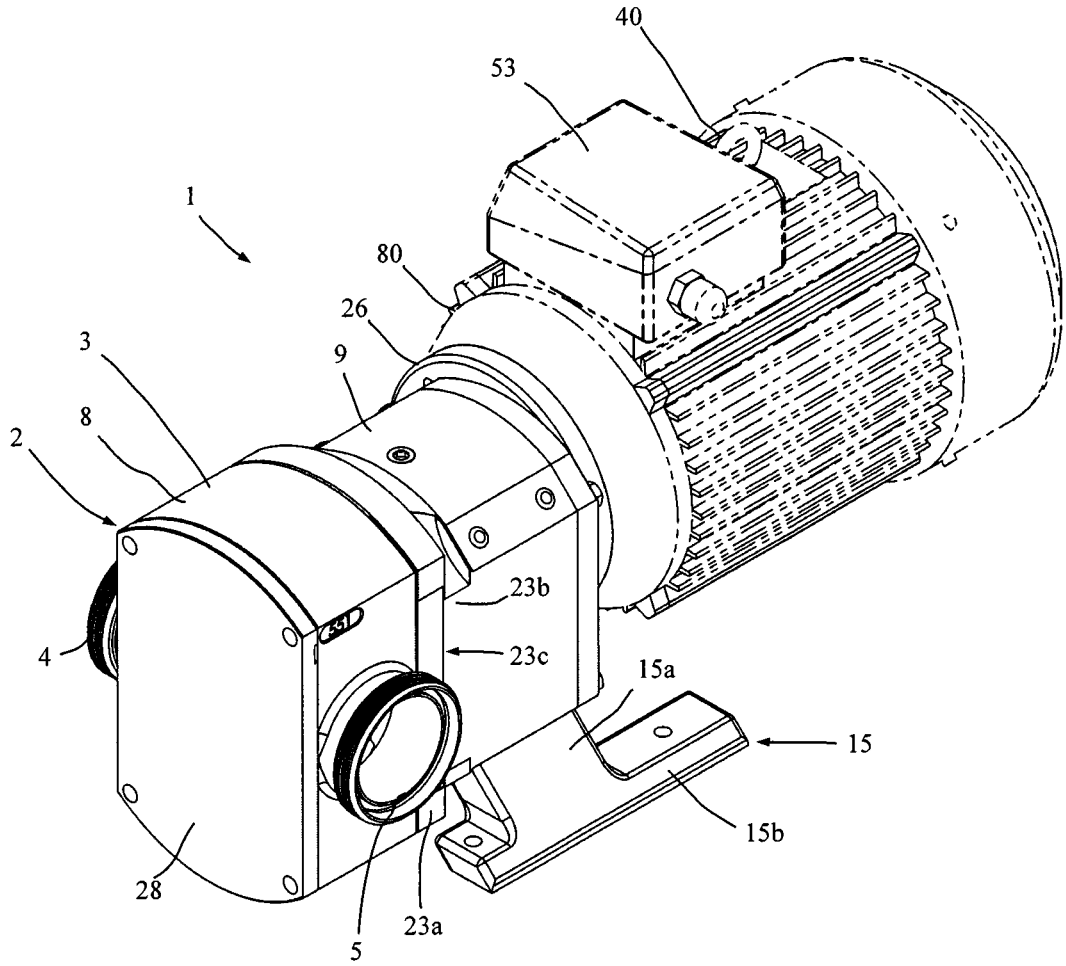
Figure 3:
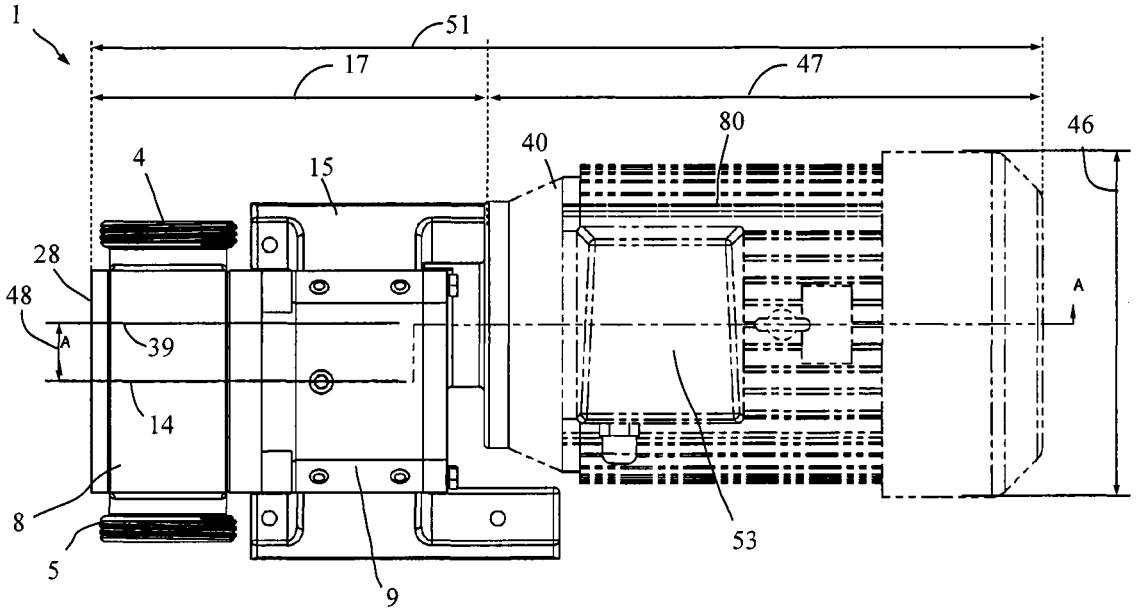
Figure 4:
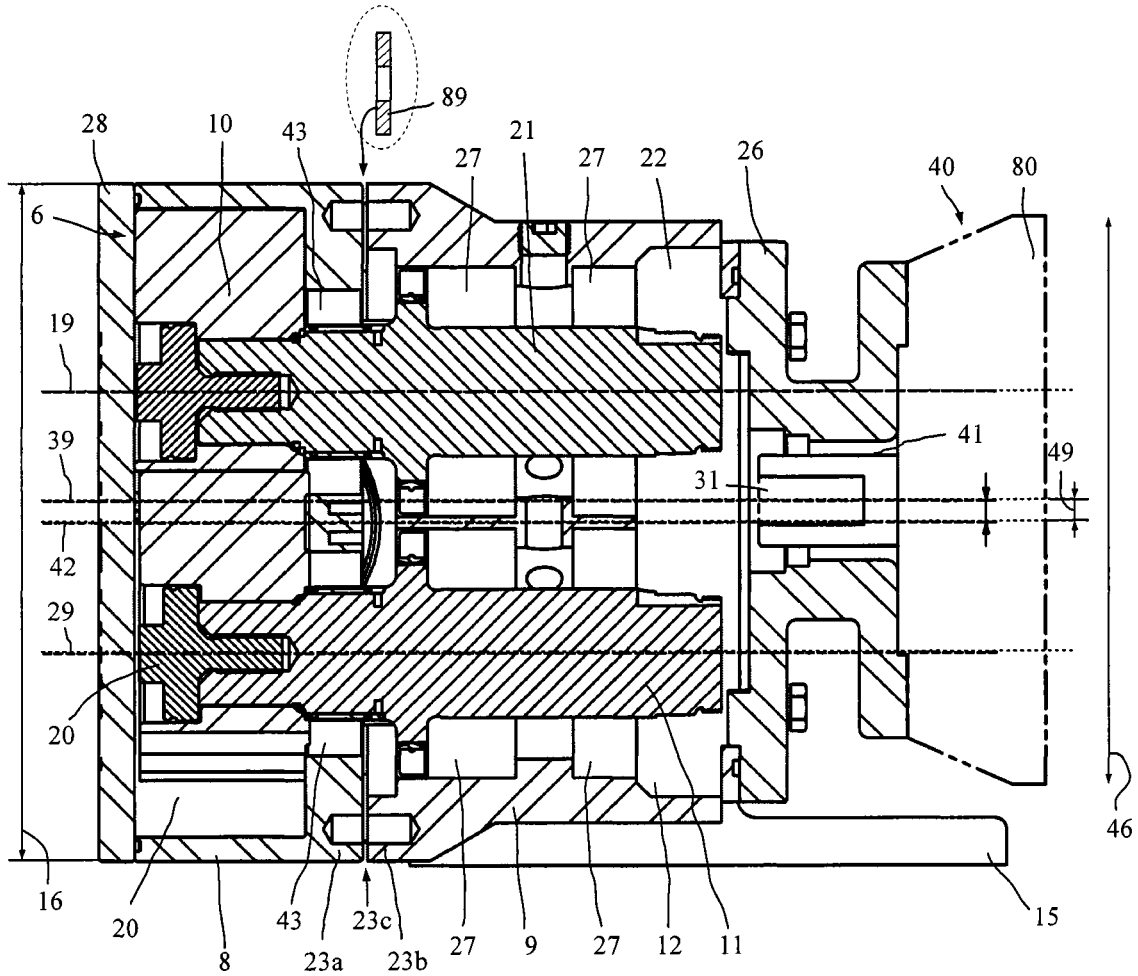
Figure 5:
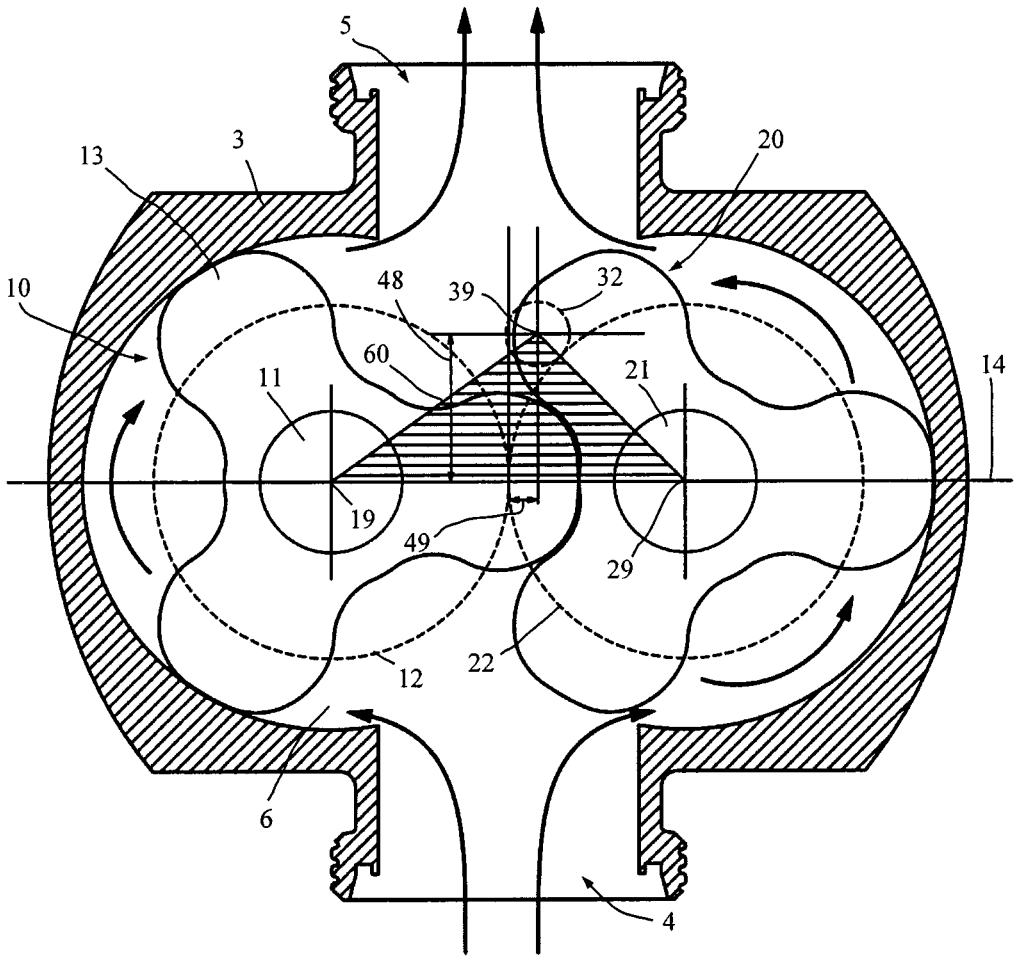
Figure 6:
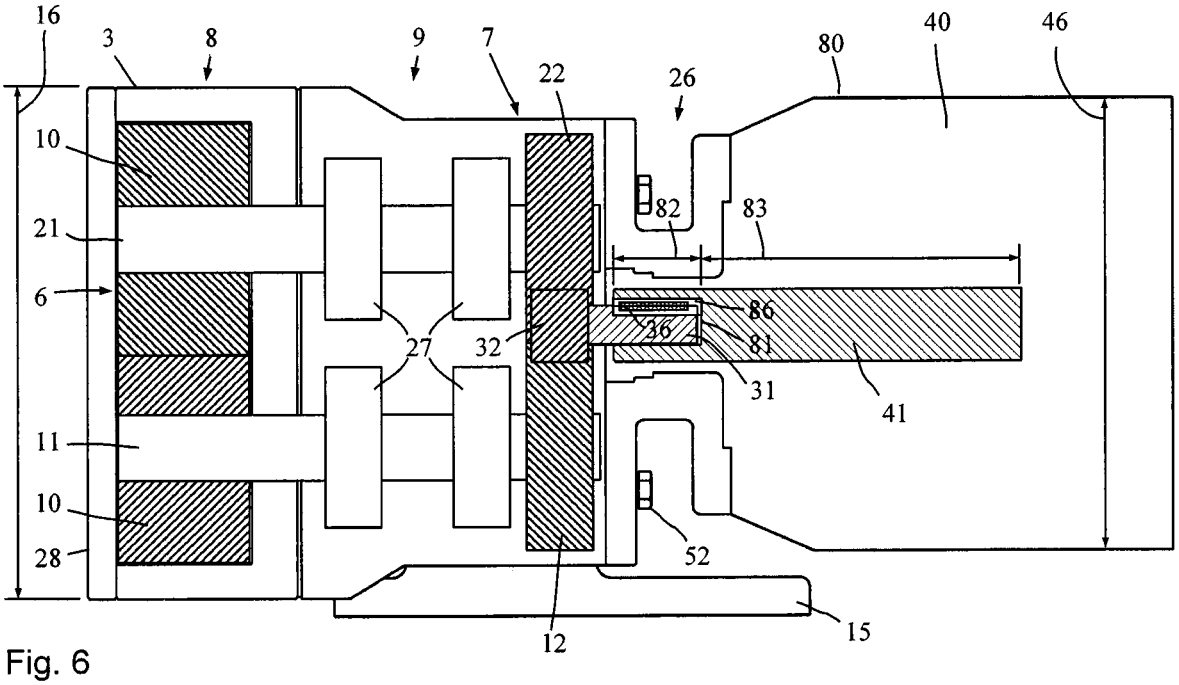
Figure 7:
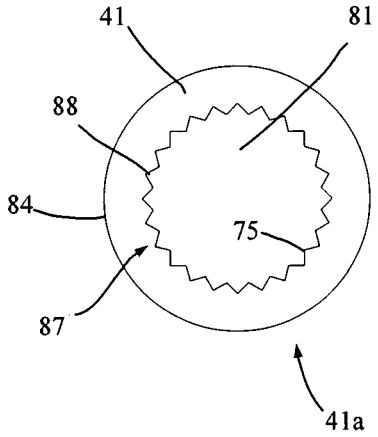
Figure 8:
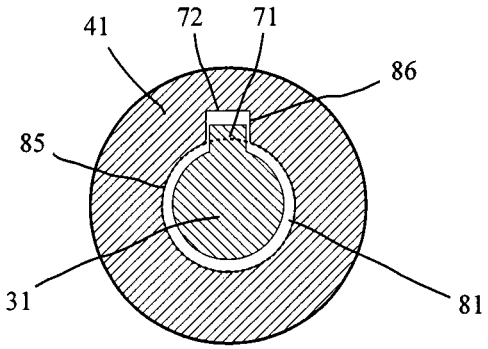
Figure 9:
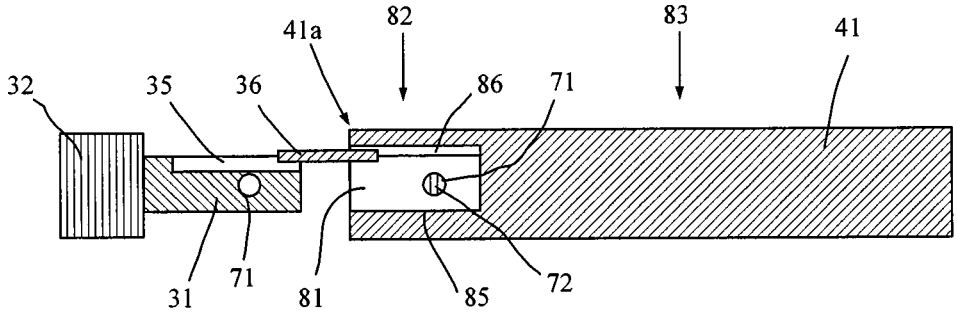
Figure 10:
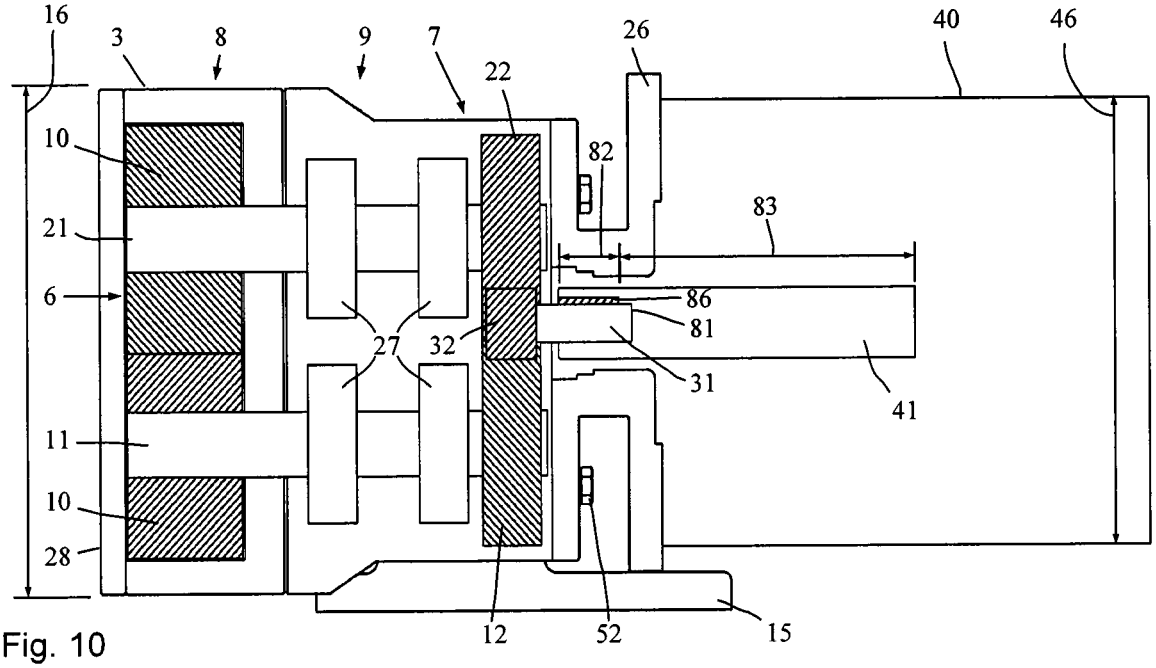
Figure 11:
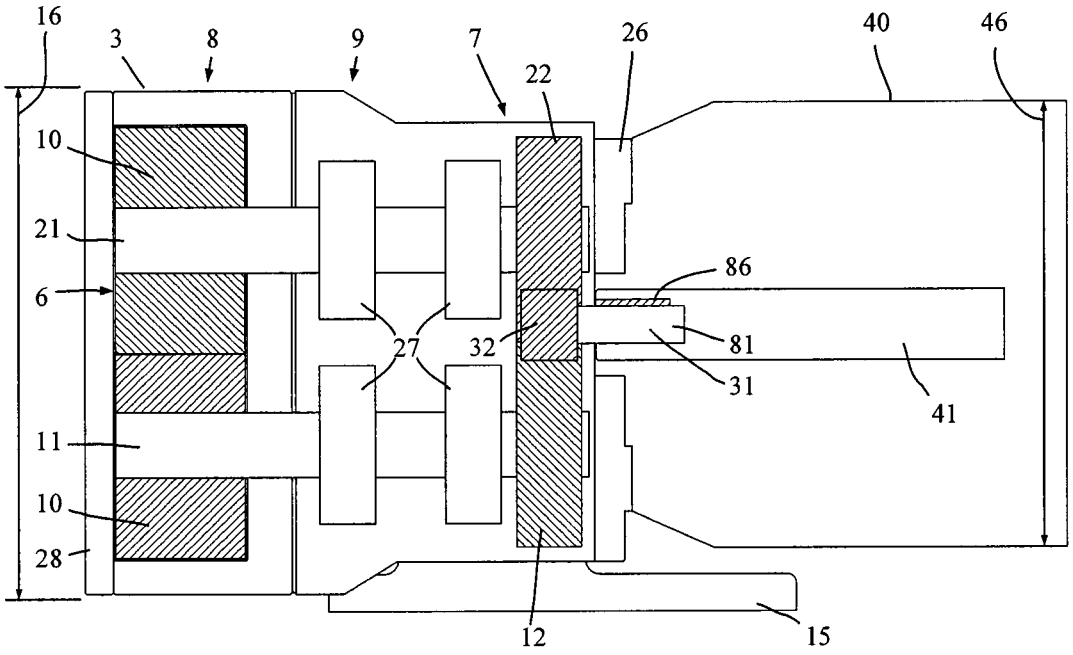

The figures show in:

FIG. 1 a mobile means of transport next to a building in a simplistic side view;

FIG. 2 a mobile pump apparatus for example for the mobile means of transport of FIG. 1;

FIG. 3 a schematic top view of the mobile pump apparatus according to FIG. 2;

FIG. 4 a cross section A-A of the housing of the pump apparatus 1 in FIG. 3;

FIG. 5 a simplistic cross section of the rotary piston pump of the mobile pump apparatus according to FIG. 2;

FIG. 6 a simplistic cross section of a mobile pump apparatus according to the invention;

FIG. 7 a view of the front end of a configuration of the motor shaft;

FIG. 8 a schematic cross section of the motor shaft coupled with the drive shaft;

FIG. 9 a schematic, exploded view of the drive shaft and the motor shaft;

FIG. 10 a simplistic cross section of another mobile pump apparatus according to the invention; and FIG. 11 a simplistic cross section of yet another mobile pump apparatus according to the invention.

FIG. 1 shows a schematic side view of a mobile means of transport 100, in this case formed of a truck 102 and a tank semitrailer 101. The tank semitrailer 101, which is also a (separate) mobile means of transport 100, shows a storage tank 104 that is filled with a fluid and in particular a liquid for example in the field of foodstuffs.

The mobile means of transport 100 comprises wheels 103. In the rear region of the tank semitrailer 101 a pump apparatus 1 is disposed beneath the bulge of the storage tank 104 protruding rearwardly. Optionally, the truck 102 which is the towing vehicle may alternatively or additionally be provided with a mobile pump apparatus 1, as the dashed arrow indicates. Beneath the longitudinal beam of the trailer a pump apparatus 1 may also be mounted in the longitudinal direction as it is drawn between the towing vehicle and the rear wheels 103 of the semitrailer 101 beneath the semitrailer frame. It can be clearly seen that in this preferred mounting position the total length of the pump apparatus 1 and also the total height is most significant. A short configuration showing little height is advantageous. A lower weight is also advantageous since it increases the feasible payload.

The pump apparatus 1 disposed in the rear region is connected with a power connection 201 of a building 200 via a connecting cable 38 and a plug connector 38*a*. The operating energy for the pump apparatus 1 is thus extracted from the power system of the building 200. This means that the motor of the truck 102 may remain switched off for example while the storage tank 104 is drained or partially drained. This lowers energy consumption and noise generation.

At the same time the hose 18 is connected with the pump outlet 5 of the pump apparatus 1. The other end of the hose 18 is connected with the fluid connection 202 of the building 200.

To ensure reliable operation in a great variety of locations and buildings 200, the drive motor 40 (see FIG. 2) of the pump apparatus 1 is generally used as a modified standard motor having a capacity of for example 7.5 kW which can be operated from conventional rotary current or heavy current junctions. Prior to installing, the drive motor 40 is adapted to the pump apparatus 1.

The pump apparatus 1 is controlled by the control unit 24 which comprises a frequency converter 25 for controlling the rotational speed of the drive motor and thus of the rotary piston pump.

FIG. 2 shows a schematic, perspective view of a pump apparatus 1 employed for example with the mobile means of transport 100. The pump apparatus 1 comprises a housing 3 and connected therewith, an (electric) drive motor 40. The drive motor 40 is connected with the housing 3 via a junction flange 30. It is also possible for the junction flange 30 to double as the front end of the drive motor 40 and the rear end of the housing 3 and to be configured as a connecting flange (see FIG. 10).

The housing 3 comprises a pump housing part 8 and subsequently, a gear housing part 9 in which the drive speed of the drive motor 40 is reduced and distributed between the two rotor units 10 and 20 (see FIG. 3) of the rotary piston pump 2. The pump housing part 8 and the gear housing part 9 each show an end wall or partition wall 23*a* and 23*b* which are separated from one another by a gap 23*c* (freely accessible from outside). In the case of leaks in the shaft bushings, oil or product would pass through the gap 23*c* out of the pump housing part 8 or out of the gear housing part 9 into the gap 23*c* and thus outwardly but not into the other housing part.

The pump housing part 8 shows the pump inlet and the pump outlet configured as pump openings 4 and 5. The entire pump apparatus 1 is attached via a foot unit or bracket 15 for example to the control cabinet or to the vehicle body of a mobile means of transport 100. The foot unit 15 is provided with legs 15*a* and feet 15*b* (disposed symmetrically) which also enable vibration damping.

FIG. 3 shows a top view of the pump apparatus 1 according to FIG. 2 wherein the left portion of FIG. 3 shows the pump housing part 8 with the inlet 4 and the outlet 5 which are followed by the gear housing part 9 and the drive motor 40. The drive motor 40 is screwed to a junction flange 30 and thus connected with the rotary piston pump 2.

In FIG. 3 one can see that a middle plane with the rotation axis 39 of the drive motor 40 shows a lateral distance 48 to a middle plane 14 in which the rotation axes of the rotor units of the rotary piston pump 2 are disposed.

At the front end of the pump apparatus 1 the pump chamber 6 of the pump housing part 8 is closed by a cover 28. The pump apparatus 1 enables a compact structure. The length 17 of the housing 3 including the pump housing part 8, the gear housing part 9 is shorter than the length 47 of the drive motor 40. This makes the total length 51 shorter than double the length 47 of the drive motor 40.

FIG. 4 shows a cross section A-A of FIG. 3 wherein just a small portion of the drive motor 40 is illustrated. FIG. 4 shows the internal structure in the pump housing part and the gear housing part 8 and 9.

The section according to FIG. 4 extends through the rotor plane in which the rotor shafts 11 and 21 which are parallel to one another show their rotation axes 19 and 29. In the region of the drive motor 40 the illustrated section extends through the rotation axis 39 of the drive motor 40. The rotation axis 39 of the drive motor 40 is identical with the rotation axis of the drive pinion 32 (see FIG. 6). The drive pinion 32 is not visible in the illustration of FIG. 4 since it is located in front of the sectional plane in the region of the housing 3.

The rotary piston pump 2 comprises two rotor shafts 11 and 21, each having rotation axes 19 and 29. The middle plane 42 lies exactly between the rotation axes 19 and 29. The rotation axes 19 and 29 are aligned in parallel to one another. Rotor units 10 respectively 20, which generate the actual pumping effect, are disposed on the rotor shafts 11 and 21 in the pump chamber 6 in the pump housing part 8. The rotor units 10 respectively 20 are attached or screwed to the rotor shafts 11 respectively 21 by means of fasteners 44. The pump housing part 8 is separated from the gear housing part 9 by two partition walls 23*a* and 23*b*. The two rotor shafts 11 and 21 pass through the partition walls 23*a* and 23*b*. The bushings are provided with seals 43 to prevent filled fluid from flowing out of the pump housing part into the gear housing part and to reliably prevent reverse flow into the conveyed fluid.

The rotor shafts 11 and 21 are supported axially spaced apart from one another via two (preferably conventional) bearing units 27 to ensure reliability of function. Furthermore, the rotor shafts 11 and 21 non-rotatably accommodate rotor gear wheels 12 and 22. The rotor gear wheels 12 and 22 show identical numbers of teeth and identical dimensions. The rotor gear wheels 12 and 22 mesh with one another so that rotating one of the rotor gear wheels causes rotation of the other of the rotor gear wheels in the opposite sense. This ensures that both the rotor shafts and thus both the rotor units 10 and 20 rotate in opposite senses and synchronously in operation. The two bearing units 27 are axially disposed between the rotor gear wheel 12 (or 22) and the rotary unit 10 (or 20).

When exchange of a drive motor 40 is intended for example in the case of a defect, the drive motor 40 is unscrewed from the junction flange 30. The same or a similar make may be reworked so that the front end 41*a* of the motor shaft 41 shows an appropriate recess 81 that is suitable for coupling with the drive shaft 31.

A non-rotatable connection between the motor shaft 41 of the drive motor 40 and the drive shaft 31 may be formed by way of the recess 81 of the motor shaft 41 showing a longitudinal groove 86 and the drive shaft 31 comprising an axial groove 35. A coupling unit 71 in the shape of a spring 36 or the like is inserted into both grooves so as to obtain a non-rotatable connection of the motor shaft 41 with the drive shaft 31.

FIG. 4 further shows an enlarged disk part 89 that is disposed between the pump housing part 8 and the gear housing part 9. Multiple disk parts 89 are in particular disposed on the connecting screws distributed over the circumference. The disk parts 89 ensure a defined distance (23*c*) of the two housing parts 8 and 9.

FIG. 5 shows a front view of a simplistic cross-sectional view of the actual piston pump wherein the rotor units 10 and 20 can be identified, configured with three rotor elements 13 each. The three-way rotor units 10, 20 are non-rotatably attached to the rotor shafts 11, 21 and rotate in opposite senses in operation so that the flow direction shown by the inserted arrows ensues for the fluid conveyed from the pump inlet 4 to the pump outlet 5.

FIG. 5 additionally shows in dashed lines the outer contours of the intermeshing rotor gear wheels 12, 22 and of the drive pinion 32 which e.g. meshes with the rotor gear wheel 22. A mirror-inverted arrangement is also conceivable. Also possible is a structure where the drive pinion 32 only meshes with the rotor gear wheel 12. At any rate the drive pinion 32 only meshes with one of the rotor gear wheels 12, 22.

FIG. 5 also shows the rotation axes 19, 29 and 39 of the rotor gear wheels 12, 22 and of the drive pinion 32. In the cross section according to FIG. 5 the three rotation axes 19, 29 and 39 form a triangle 60, in horizontal hachure, where each rotation axis 19, 29 and 39 forms one corner point of the triangle 60. The rotation axis 19 is disposed at a distance 48 from the rotor plane 14. The rotor plane 14 is opened up by the parallel rotation axes 19 and 29. The rotation axis 39 of the drive pinion 32 is located between the rotation axes 19 and 29 in a perpendicular projection on the rotor plane 14. The distance 49 from the center between the rotation axes 19 and 29 is comparatively small and amounts to less than ⅓ and in particular less than ¼ or ⅙ of the distance between the rotation axes 19 and 29. The distance 49 is larger than 0 and preferably larger than 1/40 or 1/20 of the distance between the rotation axes 19 and 29. At any rate it must be ensured that the drive pinion 32 only meshes with one of the rotor gear wheels 12, 22. The drive pinion 32 and the rotor gear wheel 22 together form a reduction gear transmission 7.

A triangle 60 with internal angles of <90° causes a particularly compact structure requiring little structural height and structural width (seen in the conveying direction from inlet to outlet). Omitting the unnecessary separate reduction gear transmission also saves considerable mounting length so that a particularly small, compact pump apparatus 1 is provided.

FIG. 6 finally shows a simplistic longitudinal section of a pump apparatus 1 according to the invention whose principle is shown in the FIGS. 2 to 5. FIG. 10 shows a slightly different configuration wherein all the functions are basically the same though.

The rotor shafts 11, 21 are equipped with rotor units 10, 20 and rotor gear wheels 12, 22. The two rotor gear wheels 12, 22 are also located in the gear housing part 9 of the housing 3 as are the bearing units 27. The drive pinion 32 is coupled to one of the two rotor gear wheels 12, 22, in this case to the rotor gear wheel 12. The drive pinion 32 meshes with the rotor gear wheel 12. The rotor gear wheel 12 in turn meshes with the rotor gear wheel 22. Consequently, as the drive pinion 32 rotates the two rotor units 10, 20 rotate in the opposite sense and at the same speed. The drive shaft 31 is rotatably supported in the gear housing part 9 via bearing units (not shown). The drive shaft 31 is passed out of the gear housing part 9 into the motor housing 80. There the drive shaft 31 is non-rotatably connected with the motor shaft 41. A non-rotatable connection of the motor shaft 41 with the drive shaft 31 may be ensured by means of axial grooves and an inserted spring 36. Other connecting options are likewise feasible. The drive shaft 31 is accommodated in a recess 81 of the motor shaft 41. Therefore the motor shaft 41 may show any desired outer periphery and outer cross-section. The outer periphery or the outer surface may in particular be defined by a cylinder which closely bears against the outer surface.

Coupling the drive shaft in the interior of the motor shaft 41 allows to save mounting space and weight. Basically, a standard motor is used whose front end 41*a* of the motor shaft is bored or milled open or otherwise hollowed out for forming a defined recess 81. The recess 81 may be basically cylindrical. A mill-cutter or other tool may form a longitudinal groove in the recess 81 so as to enable a non-rotatable connection with the drive shaft 31. For a non-rotatable connection a coupling unit or spring 36 is inserted into the longitudinal groove 86 and the axial groove 35.

The variant shown in FIG. 6 has the advantage that drive motors so equipped may optionally be replaced by other makes as long as the speed range and the power range and the mechanical joints generally match. The recess 81 may be made on site. Repairs are thus feasible within short time periods even in remote regions and corners.

The fact that the rotation axis 39 of the drive shaft 31, which is projected onto the rotor plane 14 opened up by the rotation axes 19 and 29 of the rotor shafts 11 and 21, is located between the rotation axes 19 and 29, allows to achieve a particularly compact structure of the pump apparatus 1 according to the invention. As is schematically shown in FIG. 6 and as can also be seen in FIGS. 3 and 4, the entire pump apparatus 1 or the housing 3 of the pump apparatus has a height 16 which is only slightly higher than the diameter 46 of the drive motor 40. In particular the drive motor 40 with its housing and its cooling fins does not protrude upwardly or downwardly beyond the housing 3 of the pump apparatus 1.

FIG. 7 shows a schematic view of the front end 41*a* of the motor shaft 41 which allows a view into the interior of the recess 81. The recess 81 extends over a length of a coupling section 82. This is followed by a second section 83 which may for example partially and in particular entirely extend in the interior of the motor housing 80. As in FIG. 6, the coupling section 82 may extend entirely inside of the motor housing 80 but it may extend at least partially from there into the housing 3.

FIG. 7 shows exemplarily an internal toothing 88 as a non-round inner contour 87. The internal toothing 88 meshes in operation with a closely abutting external toothing 75 of the drive shaft 31. The outer peripheral surface of the motor shaft 41 may be configured as a cylindrical, peripheral surface 84.

FIG. 8 shows a schematic cross section of the motor shaft 41 connected with the drive shaft 31. The dimensions are not true to scale but illustrated purely schematically. Thus for example the tolerances are considerably narrower in reality. The motor shaft 41 surrounds the drive shaft 31 which is accommodated in the recess 81. The recess is basically configured as a cylindrical cavity. The recess 81 also includes (at least) one longitudinal groove 86 extending radially further outwardly (but not entirely outwardly). The drive shaft 31 (or its rear end) is accommodated in the substantially cylindrical recess 81. A radial appendix as a coupling unit may be accommodated in the longitudinal groove 86 in a close fit to establish a non-rotatable coupling.

FIG. 9 shows a stretched illustration of a variant where the recess 81 is configured with a longitudinal groove 86 into which a spring 36 is inserted which is also accommodated in an axial groove 35 of the drive shaft 31 and enables a non-rotatable coupling.

It is also possible for the drive shaft 31 and the motor shaft 41 to each comprise e.g. one (or more) transverse bores for coupling units 71. The aligned transverse bores allow to pass through a pin or the like as a coupling unit 72 (shown in the motor shaft in a schematic section) and to establish non-rotatable coupling. The pin may also be screwed or glued or clamped in.

FIG. 10 shows a modification of the configuration of the FIGS. 2 to 4, where a connecting flange 26 is used which forms the rear cover lid of the housing 3 and (at the same time) also the front cover lid of the motor housing 80. The connecting flange 26 in particular comprises two circumferential flanges running spaced apart in parallel which form a circumferential "U" that opens outwardly. The intermediate space remaining between the walls of the "U" allows ease of mounting and demounting.

FIG. 11 shows yet another modification of the configuration of the FIGS. 2 to 4 wherein a particularly short connecting flange 26 is used which forms the rear cover lid of the housing 9 and (at the same time) also the front cover lid of the motor housing 80. In simple configurations the connecting flange 26 may be a disk-shaped ring. At any rate a circumferential flange is configured on one side of which the gear housing part 9 is disposed and on the other side of which, the drive motor 40. The drive motor 40 and the gear housing part 9 are preferably each connected with the flange 26. They can also be connected with one another through shared connecting members with the flange 26 clamped in-between. In this design the flange 26 forms the end of the gear housing part 9 and also the end of the housing of the drive motor 40.

Apart from the configuration of the flanges 26 the configurations according to the FIGS. 10 and 11 may each show all the features of the preceding exemplary embodiments so that the FIGS. 10 and 11 neither include nor describe each single reference numeral. In this respect reference is made to the preceding statements in the general description and the description of the other exemplary embodiments.

The configuration according to FIG. 10 may allow a shorter mounting length than the configurations described previously since the motor may be configured shorter.

The design according to FIG. 11 allows an even shorter configuration than do all the others since the connecting flange 26 is virtually only a thin, plate-like flange while at the same time forming the front end of the motor housing. Mounting may accordingly be performed sequentially.

The drive pinion 32 is preferably a component separate from the motor shaft 41. The drive pinion 32 or its shaft part may be press-bonded with the motor shaft 41. Another force- or form-fit connection is also possible of the drive pinion 32 (respectively the shaft part of the drive pinion 32) and the motor shaft 41.

In all the configurations the drive pinion 32 may be directly incorporated in, or configured on, the motor shaft 41. The drive pinion 32 may be configured integrally with the motor shaft 41.

Unlike the illustration in FIG. 2, the terminal box 53 of the drive motor 40 is preferably disposed rotated to the front or to the rear (parallel to the connecting line of the inlet and outlet) so that it does not protrude upwardly (or downwardly) and thus requires particularly little mounting space.

As FIG. 3 shows, a very compact design is also achieved in the lateral direction. The compact structure in height and in the lateral direction is achieved in that the rotation axes 19 and 29 of the rotor shafts 11 and 21 are disposed on one shared rotor plane 14 while the rotation axis 39 of the drive shaft 31 is provided laterally spaced apart so that a view transverse to the illustration in FIG. 4 shows a triangle of the rotation axes 19, 29 and 39 which does not show any obtuse angle and thus provides a particularly compact rotary piston pump.

Saving a separate reduction gear transmission stage leads to saving mounting space and considerably reducing the total weight. The saving of weight is noticeably increased in that the drive shaft 31 is accommodated in the recess 81 of the motor shaft 41. The outer periphery of the motor shaft 41 does not need to be enlarged, although it may. The recess 81 may be incorporated into a standardized motor shaft having a cylindrical outer periphery. Enlarged diameters are not required as they are when inserting the motor shaft into a clutch.

On the whole the invention provides an advantageous pump apparatus with a rotary piston pump and an advantageous mobile means of transport with a pump apparatus. Both the mounting space and the weight may be reduced without reducing reliability.

| List of reference numerals: | |
|---|---|
| 1 | pump apparatus |
| 2 | rotary piston pump |
| 3 | housing |
| 4 | pump opening, inlet |
| 5 | pump opening, outlet |
| 6 | pump chamber |
| 7 | reduction gear transmission |
| 8 | pump housing part |
| 9 | gear housing part |
| 10 | rotor unit |
| 11 | rotor shaft |
| 12 | rotor gear wheel |
| 13 | rotor element |
| 14 | rotor plane |
| 15 | bracket |
| 15a | leg |
| 15b | foot |
| 16 | height of 3 |
| 17 | length of 3 |
| 18 | hose |
| 19 | rotation axis of 12 |
| 20 | rotor unit |
| 21 | rotor shaft |
| 22 | rotor gear wheel |
| 23a | partition wall |
| 23b | partition wall |
| 23c | gap |
| 24 | control unit |
| 25 | frequency converter |
| 26 | connecting flange |
| 27 | bearing unit |
| 28 | cover wall, lid |
| 29 | rotation axis of 22 |
| 30 | connecting flange |
| 31 | drive shaft |
| 32 | drive pinion |
| 35 | axial groove |
| 36 | coupling unit, spring |
| 38 | connecting cable |
| 38a | plug connector |
| 39 | rotation axis of 32 |
| 40 | drive motor |
| 41 | motor shaft |
| 41a | front end |
| 42 | middle plane between 19 and 29 |
| 43 | seal of 11, 21 |
| 44 | attachment of 10, 20 |
| 46 | diameter |
| 47 | length |
| 48 | lateral distance |
| 49 | vertical offset |
| 51 | length |
| 52 | screw |
| 53 | terminal box |

-continued

| List of reference numerals: | |
|---|---|
| 60 | triangle |
| 71, 72 | coupling unit |
| 75 | external toothing |
| 80 | motor housing |
| 81 | recess |
| 82 | coupling section |
| 83 | inner section |
| 84 | peripheral surface |
| 85 | cylindrical cavity |
| 86 | longitudinal groove |
| 87 | non-round inner contour |
| 88 | internal toothing |
| 89 | disk |
| 100 | mobile means of transport |
| 101 | tanker semitrailer |
| 102 | truck |
| 103 | wheels |
| 104 | storage tank |
| 200 | building |
| 201 | power connection |
| 202 | fluid connection |

The invention claimed is:

1. A mobile pump device for use on mobile transport vehicle selected from the group of semi-trailers, tank trailers, tank semitrailers tank trucks and lorries comprising:

a drive motor and a rotary piston pump, wherein the drive motor has a motor housing and a motor shaft for driving the rotary piston pump, wherein the rotary piston pump comprises a housing and two pump openings formed thereon, one of which serves as pump inlet and the other as pump outlet, and wherein the rotary piston pump comprises two rotor units rotatably accommodated in the housing in a pump chamber for delivering a fluid from the pump inlet to the pump outlet, wherein the two rotor units are received on rotatably mounted rotor shafts, and each rotor shaft being equipped with a rotor gear wheel arranged outside the pump chamber, wherein a drive pinion connected to a drive shaft of the rotary piston pump is coupled to one of the rotor gears, and the motor shaft of the drive motor has a recess at a front end, into which an end of the drive shaft of the rotary piston pump is received therein and the front end of the motor shaft and the drive shaft extends from the drive motor to the drive pinion;

wherein the drive motor is connected to the housing via a unitary connecting flange forming a U cross sectional shape providing a rear of a gear housing part assisting in retaining the rotor gear wheels in the gear housing part and a front of the motor housing with an intermediate space between the rear of the gear housing part and the front providing the U cross sectional shape as taken along the motor shaft.

2. The pump device according to claim 1, wherein the motor shaft comprises a coupling portion at the front end of the motor shaft on which the recess is formed.

3. The pump device of claim 1, wherein the recess forms a substantially cylindrical cavity.

4. The primp device of claim 1, wherein said recess having at least one longitudinal groove.

5. The pump device of claim 1, wherein the recess has a non-circular inner contour.

6. The pump device of claim 1, wherein an internal soothing is formed on the recess.

7. The pump device of claim 1, wherein external teeth formed or the drive shaft cooperate with internal teeth of the recess.

8. The pump device of claim 1, wherein at least one coupling unit is provided, the at least one coupling unit connected to one of the drive shaft and the motor shaft.

9. The pump device of claim 1, wherein at least one extending transverse opening is formed in the drive shaft and the motor shaft, at which opening a rotationally fixed coupling of the drive shaft and the motor shaft is achieved via a coupling unit arranged therein.

10. The pump device of claim 1, wherein the drive motor is formed as an electric motor and driven via three-phase current with a power range between 1 kW and 15 kW.

11. The pump device of claim 1, wherein the housing comprises a pump housing part and the gear housing part, wherein the rotor gears and the drive pinion are arranged in the gear housing part and the pump chamber with the rotor units is arranged in the pump housing part, wherein the pump housing part and the gear housing part are separated from each other by two separate partitions and a gap, and wherein bearing units for supporting the drive shaft and the rotor shafts are arranged in a transmission housing part.

12. The pump device of claim 11, wherein at least one disc part is arranged between the separate partitions.

13. The pump device of claim 1, wherein the housing comprises a cover which closes the pump chamber and wherein after disassembly of the cover the rotor units are accessible, and/or wherein the rotary piston pump comprises two rotor units each having a plurality of at least two rotor elements, wherein in the rotor units are plugged onto the rotor shafts and are fastened frontally to the rotor shafts.

14. The pump device of claim 1, further comprising two hearing units of a each rotor shaft arranged axially between the rotor unit and the rotor gear Wheel.

15. The pump device of claim 1, wherein the connecting flange forms a closure of the housing and the motor housing.

16. The pump device of claim 1 wherein the drive motor of the rotary piston pump is designed as an electric Motor and connected to a stationary power connection via a connecting cable.

17. The pump device of claim 1 having a foot unit extending below the pump housing in a direction away from the pump openings to a location directly below a portion of the motor.

* * * * *